US011028339B2

(12) United States Patent
Schnedler

(10) Patent No.: US 11,028,339 B2
(45) Date of Patent: Jun. 8, 2021

(54) SYSTEMS, DEVICES, AND/OR METHODS FOR MANAGING CANDLES

(71) Applicant: Leighton Schnedler, Charlottesville, VA (US)

(72) Inventor: Leighton Schnedler, Charlottesville, VA (US)

( * ) Notice: Subject to any disclaimer, the term of this patent is extended or adjusted under 35 U.S.C. 154(b) by 0 days.

(21) Appl. No.: 16/677,045

(22) Filed: Nov. 7, 2019

(65) Prior Publication Data

US 2021/0139814 A1 May 13, 2021

(51) Int. Cl.
*C11C 5/00* (2006.01)

(52) U.S. Cl.
CPC ..... *C11C 5/008* (2013.01)

(58) Field of Classification Search
CPC ..... C11C 5/008
See application file for complete search history.

(56) References Cited

U.S. PATENT DOCUMENTS

| | | | | |
|---|---|---|---|---|
| 5,879,153 | A * | 3/1999 | Slejertin | C11C 5/008 362/161 |
| 6,096,102 | A * | 8/2000 | Matthai | C11C 5/002 431/288 |
| 6,276,925 | B1 * | 8/2001 | Varga | C11C 5/008 431/288 |
| 7,959,689 | B2 * | 6/2011 | Cagle | C11C 5/002 44/275 |
| 2002/0068251 | A1 * | 6/2002 | Steck | C11C 5/008 431/288 |
| 2005/0079465 | A1 * | 4/2005 | Tillieux | C11C 5/008 431/288 |
| 2007/0006521 | A1 * | 1/2007 | Licciardello | C11C 5/008 44/275 |

* cited by examiner

*Primary Examiner* — Cephia D Toomer
(74) *Attorney, Agent, or Firm* — Dale Jensen, PLC; Dale Jensen

(57) ABSTRACT

Certain exemplary embodiments can provide a candle with an image that is not discernable until the candle is lit and an inner layer or inner layers of wax melt. As the inner layer of wax melts, an image will become discernable as light passes through the sides of the candle, through apertures in or thinner layers of the outermost layer of wax corresponding to the image to be displayed. This will allow for a candle that appears to be an ordinary candle until lit, but will reveal images after the candle is lit.

14 Claims, 5 Drawing Sheets

2000

3000

4000

5000

SYSTEMS, DEVICES, AND/OR METHODS FOR MANAGING CANDLES

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide a candle with an image that is not discernable until the candle is lit and an inner layer or inner layers of wax melt. As the inner layer of wax melts, an image will become discernable as light passes through the sides of the candle, through apertures in or thinner layers of the outermost layer of wax corresponding to the image to be displayed; the outermost layer of wax will not melt so the image will not be distorted. This will allow for a candle that appears to be an ordinary candle until lit, but will reveal images as light passes through the outermost layer of candle wax after the candle is lit. This design is advantageous in that complex images can be formed from using the typical elements in a regular candle, such as candle waxes and wicks.

Figure 1:
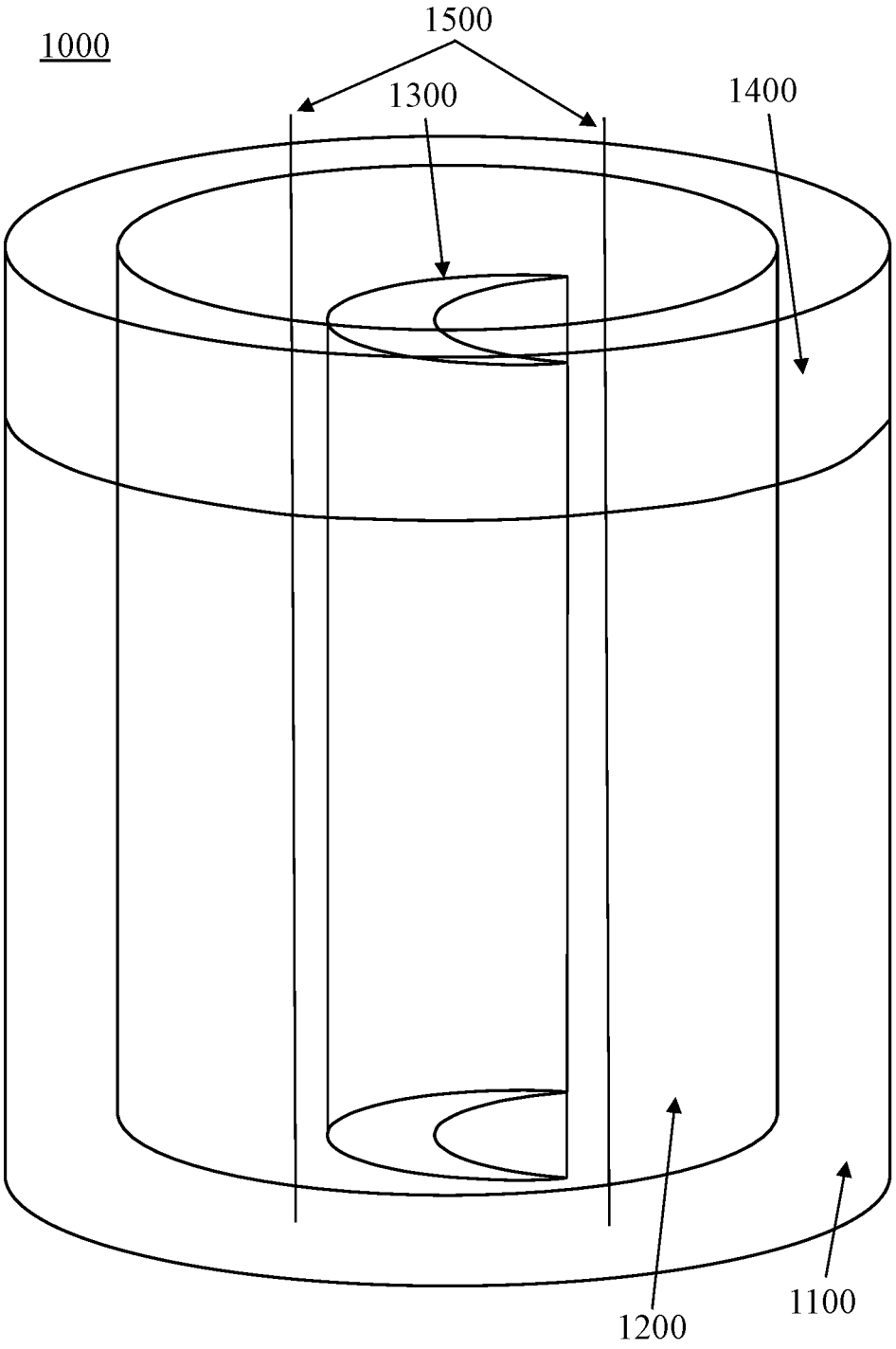
FIG. 1 is a perspective view of a diagram of an exemplary embodiment of a candle 1000.

FIG. 1 is a perspective view of a diagram of an exemplary embodiment of a candle 1000. Candle 1000 comprises a first wax layer 1100, a second wax layer 1200, and a plurality of wicks 1500. First wax layer 1100 has a first melting point. In certain exemplary embodiments, first wax layer 1100 lacks apertures in a side surface thereof.

Second wax layer 1200 can have a second melting point. In certain exemplary embodiments:

- the first melting point is greater than the second melting point; and
- as second wax layer 1200 melts, an image 1300 is visible via light passing through portions of first wax layer 1100 corresponding to image 1300, wherein wax of the portions of first wax layer 1100 corresponding to the image are thinner than other portions of first wax layer 1100.

Image 1300 is illustrated inside of candle 1000 in this drawing just so the viewer can discern the image from this perspective. All versions of these candles will have images that will be viewed from the sides, as is shown in candle 2000, candle 3000, candle 4000, and candle 5000.

Certain exemplary embodiments can comprise a third wax layer 1400. In certain exemplary embodiments, third wax layer 1400 is above the second wax layer 1200. Third wax layer 1400 can have a third melting point. In certain exemplary embodiments:

- the second melting point is greater than the third melting point; and
- third wax layer 1400 is above second wax layer 1200, wherein as second wax layer 1200 or third wax layer 1400 melts, image 1300 is revealed as light passes through first wax layer 1100.

In certain exemplary embodiments, candle 1000 is substantially cylindrical. In other exemplary embodiments, candle 1000 is not substantially cylindrical.

Figure 5:
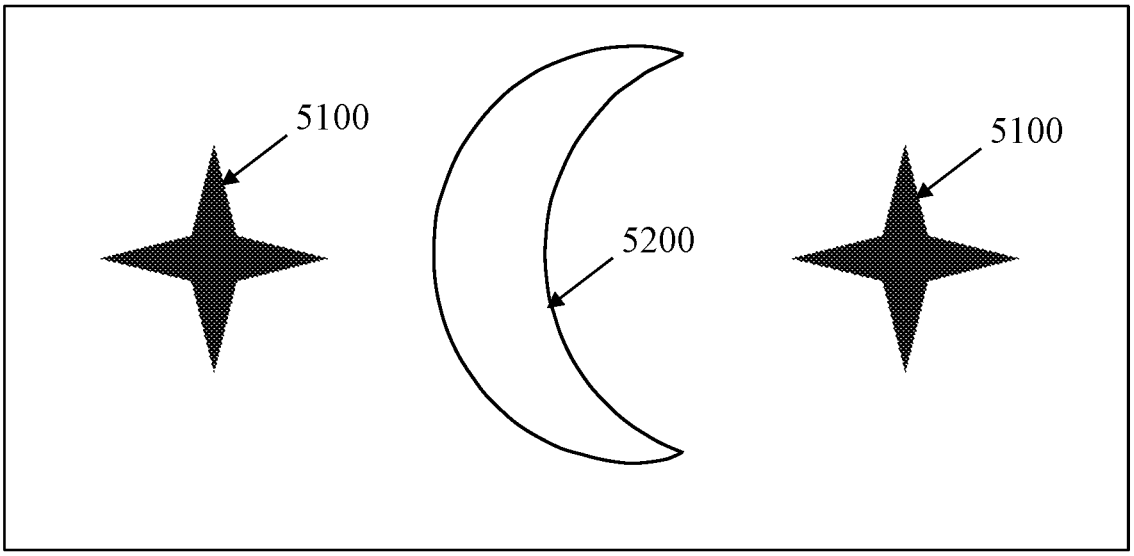
FIG. 5 is a side view of a diagram of an exemplary embodiment of a candle 5000.

In certain exemplary embodiments, candle 1000 defines a plurality of apertures in a side surface thereof (see, e.g., plurality of apertures 5100 of FIG. 5). In such embodiments, as second wax layer 1200 melts, image 1300 is visible via the plurality of apertures.

In certain exemplary embodiments, as second wax layer melts 1200, image 1300 is visible via the plurality of apertures and via light passing through portions of first wax layer 1100 corresponding to image 1300, wherein wax of the portions of first wax layer 1100 corresponding to image 1300 are thinner than other portions of first wax layer 1100. In certain exemplary embodiments, the plurality of apertures of the first wax layer is filled from wax of the second wax layer before the wick is lit such that a user cannot view the image before the wick is lit. Once the wick is lit and the second layer of wax melts, the apertures, and thus the image, will be revealed.

Figure 2:
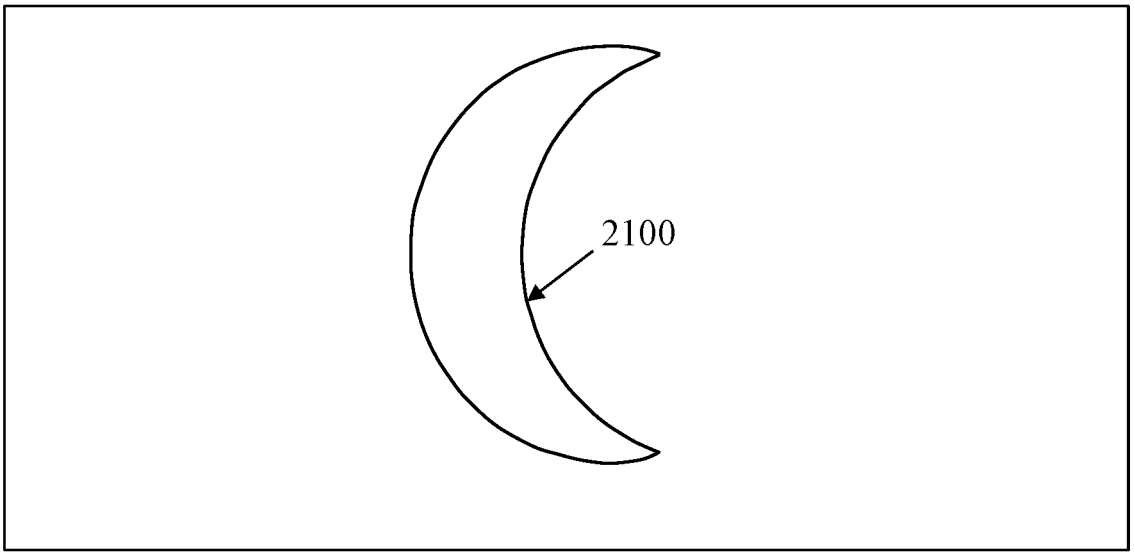
FIG. 2 is a side view of a diagram of an exemplary embodiment of a candle 2000.

FIG. 2 is a side view of a diagram of an exemplary embodiment of a candle 2000.

In certain exemplary embodiments, candle 2000 comprises waxes of various melting points. From every perspective, candle 2000 can appear as if there is only one type of wax used because the wax colors can be the same. An outermost layer, or shell, can have a highest melting point and not melt when candle 2000 is lit. The shell comprises thinner portions (but no holes) in places corresponding to a desired image 2100 to be displayed by light that is able to travel through the thinner portions of the outer layer (the light not traveling through thicker portions). An inner part of candle 2000 can comprise wax that has a lower melting point and melts when the candle 2000 is lit. As an inner portion of candle 2000 melts, image 2100 will be revealed by light shining through the thinner portions of the outer layer.

- A variation is that there can be three types of wax—same two as before, but on top of the aforementioned melting wax will be an even faster burning wax that will quickly reveal the image, then the slower-melting wax allows for the image to be displayed longer than if the entire interior of candle 2000 melted (since an outside of candle 2000 doesn't melt easily) as quick as the newly added, fastest burning wax.
- One wick, two wicks, or three wicks, etc.
- Round candle, candle with straight sides, etc.

Figure 3:
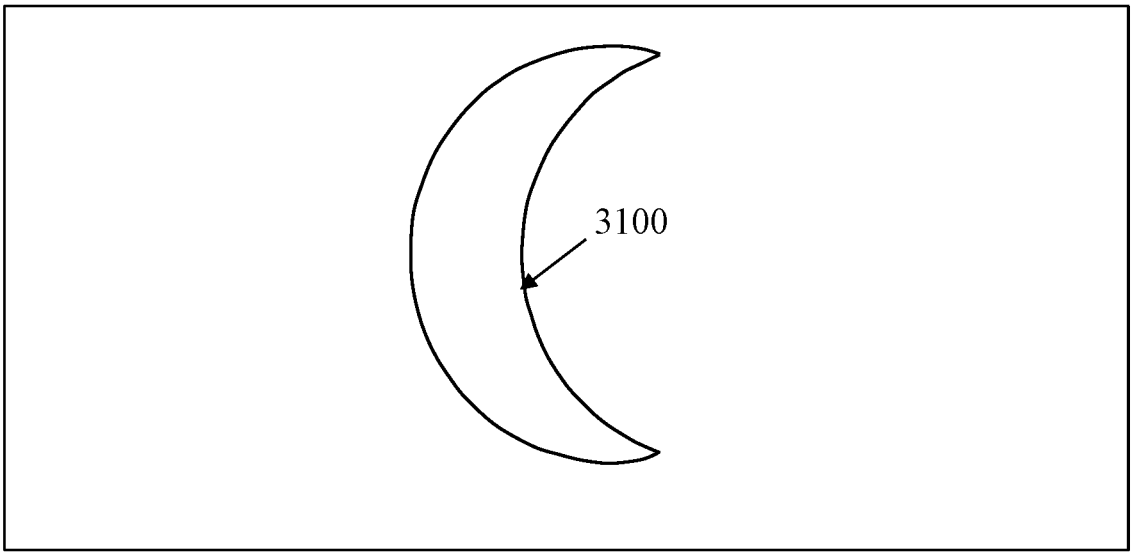
FIG. 3 is a side view of a diagram of an exemplary embodiment of a candle 3000.

FIG. 3 is a side view of a diagram of an exemplary embodiment of a candle 3000.

In certain exemplary embodiments, an image 3100 comprised by candle 3000 can be viewed and/or defined via apertures (e.g., gaps, missing pieces, etc.) (see, e.g., plurality of apertures 5100 of FIG. 5) to display image 3100 when candle 3000 melts. Even though there are apertures (e.g., gaps, missing pieces, etc.), before inner layers of wax melt, a user cannot ascertain image 3100 because the different types of wax are the same color and the gaps in the outer layer are filled by another type of wax.

- A variation of this is that there can be three types of wax. Same two as before, but on top of the aforementioned melting wax will be an even faster burning wax that will quickly reveal the image, then the slower-melting wax allows for image 3100 to be displayed longer than if the entire interior of candle 3000 melted (since an outside of candle 2000 doesn't melt easily) as quick as the newly added, fastest burning wax.

One wick, two wicks, or three wicks, etc.

Round candle, candle with straight sides, etc.

Wick(s) can be placed so that it is difficult to see the flame through an aperture (thus less glare to strain eyes, etc.)

Figure 4:
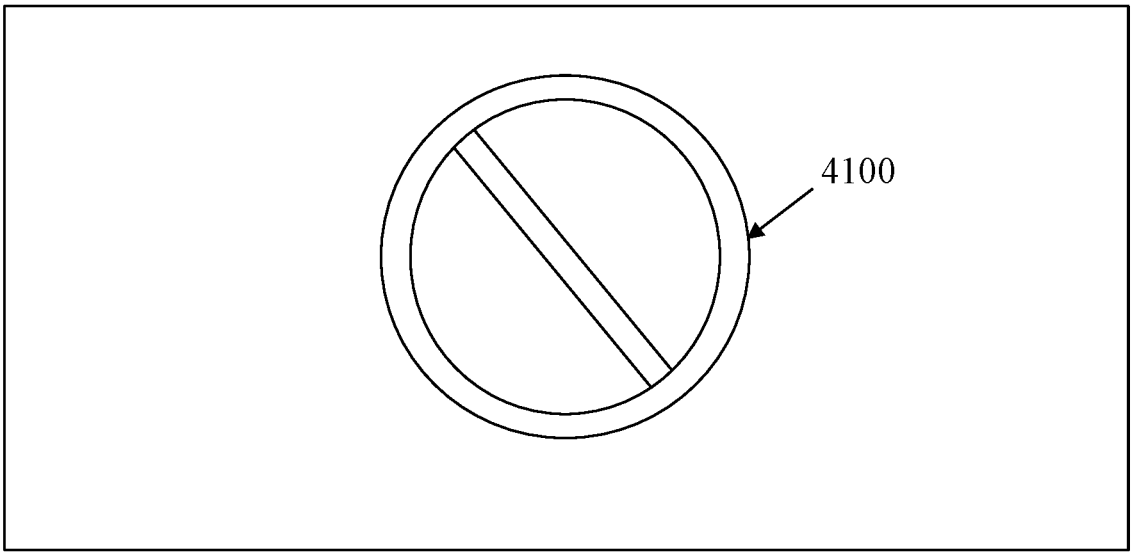
FIG. 4 is a side view of a diagram of an exemplary embodiment of a candle 4000.

FIG. 4 is a side view of a diagram of an exemplary embodiment of a candle 4000. The illustrated embodiment of aperture 4100 represents an aperture via which a user can see a flame of candle 4000. Wicks can be placed so that it is difficult to see the flame. In certain exemplary embodiments, the semi circles inside the circle of aperture 4100 fall out and the image become a circle due to there being nothing to hold the semicircles in place. In certain exemplary embodiments, image 4100 can be formed via thinner layers in a first layer of wax, but not formed by apertures. This image is provided to further communicate exemplary concepts.

FIG. 5 is a side view of a diagram of an exemplary embodiment of a candle 5000.

In certain exemplary embodiments, candle 5000 comprises waxes of various melting points. From every perspective, candle 5000 can appear as if there is only one type of wax used because the wax colors can be the same. An outermost layer, or shell, can have a highest melting point and not melt when candle 5000 is lit. The shell comprises thinner portions (but no holes) in places corresponding to a desired image 5200 to be displayed by light that is able to travel through the thinner portions of the outer layer (the light not traveling through thicker portions). An inner part of candle 5000 can comprise wax that has a lower melting point and melts when candle 5000 is lit. As an inner portion of candle 5000 melts, image 5200 is revealed by light shining through the thinner portions of the outer layer. In certain exemplary embodiments, image 5200 comprised by candle 5000 can be viewed and/or defined at least partially via apertures 5100 (e.g., gaps, missing pieces, etc.) to display the image when candle 5000 melts. Even though there are apertures 5100 (e.g., gaps, missing pieces, etc.), before inner layers of wax melt, a user cannot ascertain image 5200 because the different types of wax are the same color and the gaps in the outer layer are filled by another type of wax.

A variation of this is that there will be three types of wax. Same two as in other embodiments, but on top of the aforementioned melting wax will be an even faster burning wax that will quickly reveal image 5200, then the slower-melting wax will allow for image to be displayed longer than if the entire interior of candle 5000 melted as quick as the newly added, fastest burning wax.

One wick, two wicks, or three wicks, etc.

Round candle, candle with straight sides, etc.

Wick can be placed so that it is difficult to see the flame through apertures 5100 (thus less glare, doesn't strain eyes, etc.)

A user can view image(s) via apertures 5100 and/or a thinner outer layer. The thinner outer layer can lack apertures 5100 in certain locations.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

above—at a higher elevation relative to the surface of the earth when an object is in an upright position.

activity—an action, act, step, and/or process or portion thereof adapter—a device used to effect operative compatibility between different parts of one or more pieces of an apparatus or system.

and/or—either in conjunction with or in alternative to.

apparatus—an appliance or device for a particular purpose.

aperture—an opening in something.

associate—to join, connect together, and/or relate.

can—is capable of, in at least some embodiments.

candle—a wax object that comprises at least one wick that is lit and produces light as it burns.

cause—to produce an effect.

comprising—including but not limited to.

configure—to make suitable or fit for a specific use or situation.

connect—to join or fasten together.

constructed to—made to and/or designed to.

convert—to transform, adapt, and/or change.

correspond—to substantially match in size and shape.

couple—to join, connect, and/or link together.

create—to bring into being.

cylindrical—having a shape of a surface or solid bounded by two parallel planes and generated by a straight line moving parallel to the given planes and tracing a curve bounded by the planes and lying in a plane perpendicular or oblique to the given planes.

define—to establish the outline, form, or structure of device—a machine, manufacture, and/or collection thereof.

fill—to introduce a filling to a void during operation. A void need not be completely filled.

filling—an intended content of a void subsequent to a fill operation.

image—an at least two-dimensional representation of an object and/or phenomenon.

install—to connect or set in position and prepare for use.

lack—to be substantially devoid of layer—a quantity of material placed on the surface of something.

light—radiation that acts upon on the retina of the eye to make site possible.

may—is allowed and/or permitted to, in at least some embodiments.

melt—to turn from a solid to liquid as a result of exposure to heat.

melting point—a temperature at which a solid becomes a liquid at a fixed pressure.

method—a process, procedure, and/or collection of related activities for accomplishing something.

pass through—to transmit and/or convey in one side and out an opposite or another side of something.

portion—a part of a whole.

plurality—the state of being plural and/or more than one.

predetermined—established in advance.

provide—to furnish, supply, give, and/or make available.

receive—to get, take, acquire, and/or obtain.

repeatedly—again and again; repetitively.

request—to express a desire for and/or ask for.

set—a related plurality.

side—a bounding surface of an object.
store—to place, hold, and/or retain.
substantially—to a great extent or degree.
support—to bear the weight of, especially from below.
surface—the outer boundary of an object or a material layer.
system—a collection of mechanisms, devices, machines, articles of manufacture, processes, data, and/or instructions, the collection designed to perform one or more specific functions.
thinner—a having a lesser extent from one surface to an opposing surface than other portions of a layer.
user—a person that utilizes and/or views something.
via—by way of and/or utilizing.
view—to look at something.
visible—capable of being seen by a typical human eye.
wax—any material, such as stearin or tallow, usable to make candle bodies.
weight—a force with which a body is attracted to Earth or another celestial body, equal to the product of the object's mass and the acceleration of gravity.
wick—a waxy cord that is lit in a candle or oil lamp.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;
no characteristic, function, activity, or element is "essential";
any elements can be integrated, segregated, and/or duplicated;
any activity can be repeated, any activity can be performed by multiple entities, and/or any activity can be performed in multiple jurisdictions; and
any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A candle comprising:
a first wax layer, the first wax layer having a first melting point, the first wax layer lacking apertures in a side surface thereof;
a second wax layer, the second wax layer having a second melting point;
wherein:
the first melting point is greater than the second melting point; and
as the second wax layer melts, an image is visible via light passing through portions of the first wax layer corresponding to the image, wherein wax of the portions of the first wax layer corresponding to the image are thinner than other portions of the first wax layer.

2. The candle of claim 1, further comprising:
a third wax layer, the third wax layer having a third melting point;
wherein:
the second melting point is greater than the third melting point; and
the third wax layer is above the second wax layer, wherein as the second wax layer or third wax layer melts, the image is revealed as light passes through the first wax layer.

3. The candle of claim 1, further comprising:
a plurality of wicks.

4. The candle of claim 1, wherein:
the candle is substantially cylindrical.

5. The candle of claim 1, wherein:
the candle is not substantially cylindrical.

6. A candle comprising:
a first wax layer, the first wax layer having a first melting point, the first wax layer defining a plurality of apertures in a side surface thereof;
a second wax layer, the second wax layer having a second melting point;
wherein:
the first melting point is greater than the second melting point; and
as the second wax layer melts, an image is visible via the plurality of apertures; and
the plurality of apertures of the first wax layer filled from wax of the second wax layer such that a user cannot view the image until the second wax layer melts.

7. The candle of claim 6, further comprising:

a third wax layer, the third wax layer having a third melting point;

wherein:

the second melting point is greater than the third melting point; and the third wax layer is above the second wax layer, wherein as the second wax layer or third layer melts, the image is revealed as light passes through the first layer.

8. The candle of claim 6, further comprising:

a plurality of wicks.

9. The candle of claim 6, wherein:

the candle is substantially cylindrical.

10. The candle of claim 6, wherein:

the candle is not substantially cylindrical.

11. A candle comprising:

a first wax layer, the first wax layer having a first melting point, the first wax layer defining a plurality of apertures in a side surface thereof;

a second wax layer, the second wax layer having a second melting point;

a third wax layer, the third wax layer having a third melting point;

wherein:

the second melting point is greater than the third melting point;

the third wax layer is above the second wax layer;

the first melting point is greater than the second melting point;

the plurality of apertures of the first wax layer filled from wax of the second wax layer such that a user cannot view an image until the second wax layer melts; and as the second wax layer melts, the image is visible via the plurality of apertures and via light passing through portions of the first wax layer corresponding to the image, wherein wax of the portions of the first wax layer corresponding to the image are thinner than other portions of the first wax layer.

12. The candle of claim 11, further comprising:

a plurality of wicks.

13. The candle of claim 11, wherein:

the candle is substantially cylindrical.

14. The candle of claim 11, wherein:

the candle is not substantially cylindrical.

* * * * *